United States Patent [19]

Gueguen et al.

[11] Patent Number: 4,893,058

[45] Date of Patent: Jan. 9, 1990

[54] ARRAY ELECTRON ACCELERATOR

[75] Inventors: Jean-Pierre Gueguen, Chevilly Larue; Annick N'Guyen, Bures sur Yvette; Jacques Pottier, Orsay, all of France

[73] Assignee: Commissariat a l'Energie Atomique, Paris, France

[21] Appl. No.: 196,424

[22] Filed: May 20, 1988

[30] Foreign Application Priority Data

May 26, 1987 [FR] France ..... 87 07379

[51] Int. Cl.[4] ..... H01J 25/02

[52] U.S. Cl. ..... 315/5; 315/5.29; 315/5.35; 315/5.38; 315/5.51

[58] Field of Search ..... 315/5, 5.24, 5.29, 5.35, 315/5.38, 5.39, 5.41, 5.42, 5.51; 331/79

[56] References Cited

U.S. PATENT DOCUMENTS

| | | | |
|---|---|---|---|
| 2,405,612 | 8/1946 | Schelkunoff | 315/5.51 |
| 2,452,561 | 11/1948 | Gibson | 315/5.51 |
| 2,838,710 | 6/1958 | Coeterier | 315/5.51 |
| 3,307,194 | 2/1967 | Sheleg et al. | 315/5 |
| 3,833,814 | 9/1974 | Nablo | 250/492 |

FOREIGN PATENT DOCUMENTS

| | | |
|---|---|---|
| 0186558 | 7/1986 | European Pat. Off. . |
| 1136936 | 5/1957 | France . |

*Primary Examiner*—David Mis

*Attorney, Agent, or Firm*—Oblon, Spivak, McClelland, Maier & Neustadt

[57] ABSTRACT

A coaxial cavity (CC) resonating in accordance with the fundamental mode and the electrons are injected into the median plane perpendicular to the axis. Application to the irradiation of various strip-like substances.

3 Claims, 4 Drawing Sheets

ARRAY ELECTRON ACCELERATOR

DESCRIPTION

Figure 1:
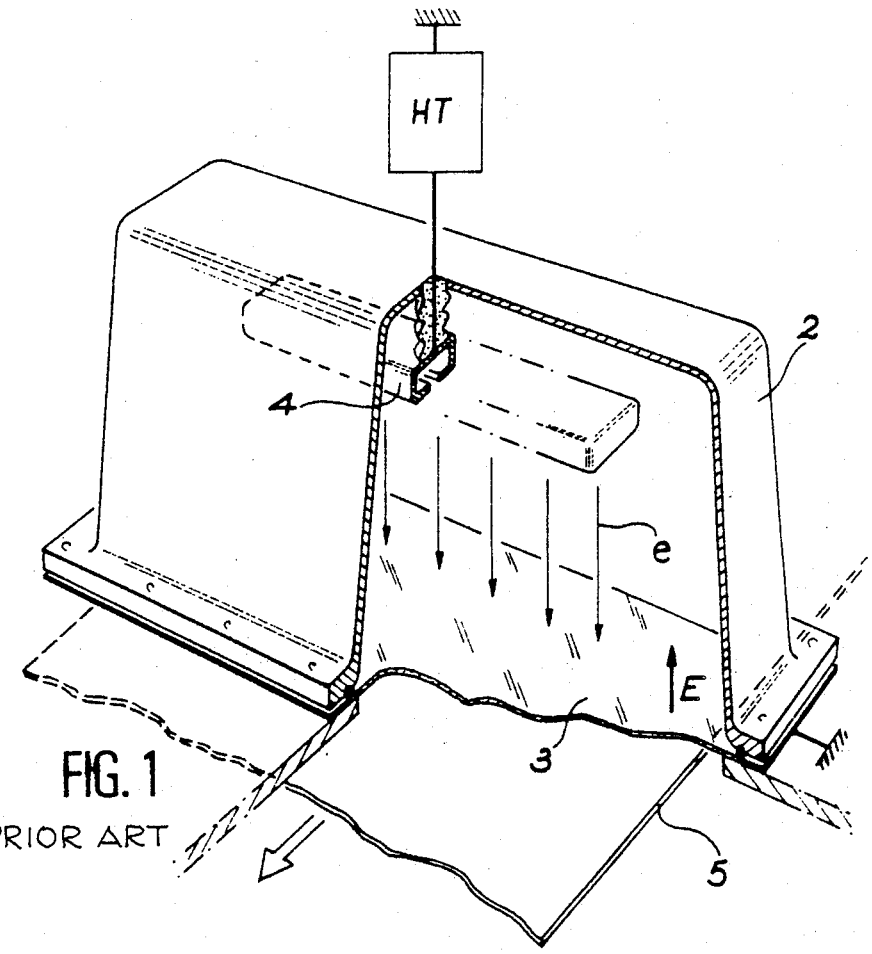
FIG. 1 PRIOR ART

The present invention relates to an array electron accelerator, which is used in the irradiation of various substances and particularly in the polymerization or cross linking of materials in the form of sheets or strips.

Array electron accelerators are already known. The principle thereof is given in FIG. 1. A vacuum chamber 2 comprises in its lower part an exit window 3, which is earthed and in its upper part a cathode K supported by an insulator 4. The cathode is connected to the negative pole of a d.c. voltage source of a few hundred thousand volts. An electric field E, directed towards the cathode accelerates the electrons emitted by the latter up to the exit window. An electron array or group is consequently formed and accelerated. It bombards a strip 5 passing beneath the chamber.

Such an apparatus suffers from numerous disadvantages. The use of a voltage of a few hundred kilovolts makes it necessary for high quality insulators to support the cathode. It is also necessary to provide a tight duct or bushing to withstand such a voltage.

If the cathode is made emissive by heating, it is necessary for the heating current source to be under high voltage, which is not advantageous. This problem can possibly be obviated by making the cathode emissive by ion bombardment using an ion source located at the window, but this increases the complexity of the apparatus.

To obviate these disadvantages, consideration can be given to accelerating the electrons by a high frequency field, which is no longer electrostatic. This field can be established in a resonant conductive enclosure. The cathode can then be raised to a potential very close to that of the enclosure and there is no longer any need for a generator or a high voltage insulator. Moreover, the cathode can be positioned outside the enclosure, which facilitates the generally difficult maintenance of electrostatic equipment.

For realizing this accelerator concept consideration can be given to the use of a parallelepipedic resonant cavity. The vibrational mode in question is such that the electric field, directed in accordance with the smallest dimension of the cavity, is constant in said direction, but is sinusoidally disputed in accordance with two other dimensions, it being at a maximum in the centre and at a minimum at the edges. By providing an electron source elongated in accordance with the greatest length, it is possible to accelerate the electrons by the thus established resonant field.

However, this arrangement suffers from two disadvantages.

1. Firstly the electronic field is no longer uniform and instead has a maximum at the centre. Thus, the energy finally reached by the electrons is a function of the trajectory thereof, the energy no longer being uniform in a cross-section of the array.

2. In the median plane of the cavity, in the vicinity of which are located the electron trajectories, there is a transverse component of the magnetic field. This field deflects the trajectory of the electrons and this deflection is a function of the phase of the wave. The beam obtained no longer makes it possible to ensure a homogenous irradiation.

The object of the present invention is to obviate these disadvantages. It therefore proposes an electron accelerator using a cavity, whereof the original shape in this application makes it possible to obtain a uniform accelerating field without any deflecting magnetic field. This result is obtained by using a generally coaxial structure.

More specifically, the present invention relates to an array electron accelerator having a linear cathode emitting an array-like electron beam, an accelerating structure where there is an electric field directed into the plane of the array, characterized in that the accelerating structure is a coaxial cavity constituted by an external cylindrical conductor and an internal cylindrical conductor having the same axis, said cavity being excited by a high frequency source to the resonant frequency of the fundamental mode and in that the cathode is contained in the median plane of the cavity perpendicular to the axis, the electron beam emitted by the cathode being injected into the cavity in said median plane, the external and internal cylinders having openings, in the form of circular arcs centred on the axis of the cavity for the passage of the beam.

The invention is described in greater detail hereinafter relative to the attached drawings, wherein show:

FIG. 1, already described, a prior art apparatus.

Figure 2:
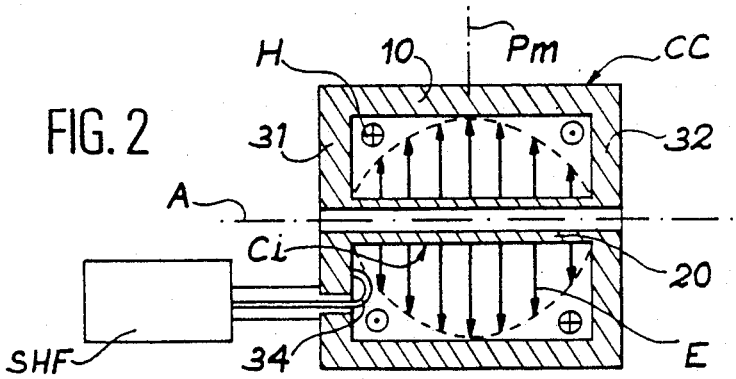

FIG. 2, a coaxial cavity resonating according to the fundamental mode.

Figure 3:
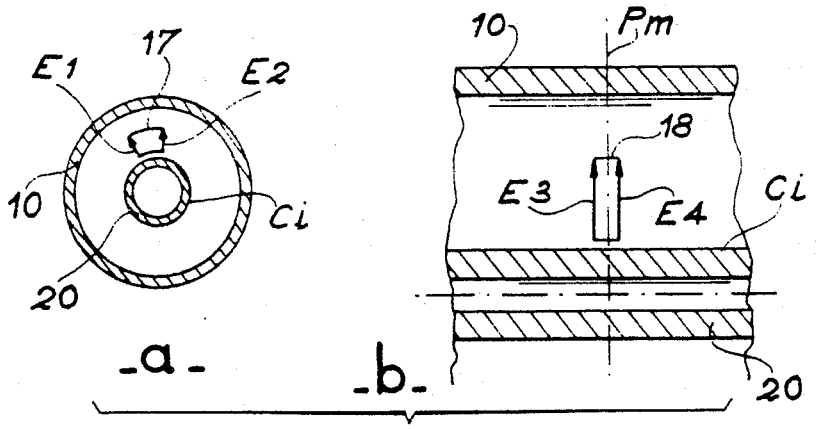

FIG. 3, a property of the coaxial cavity relative to the absence of a magnetic field in the median plane of the cavity.

Figure 4:
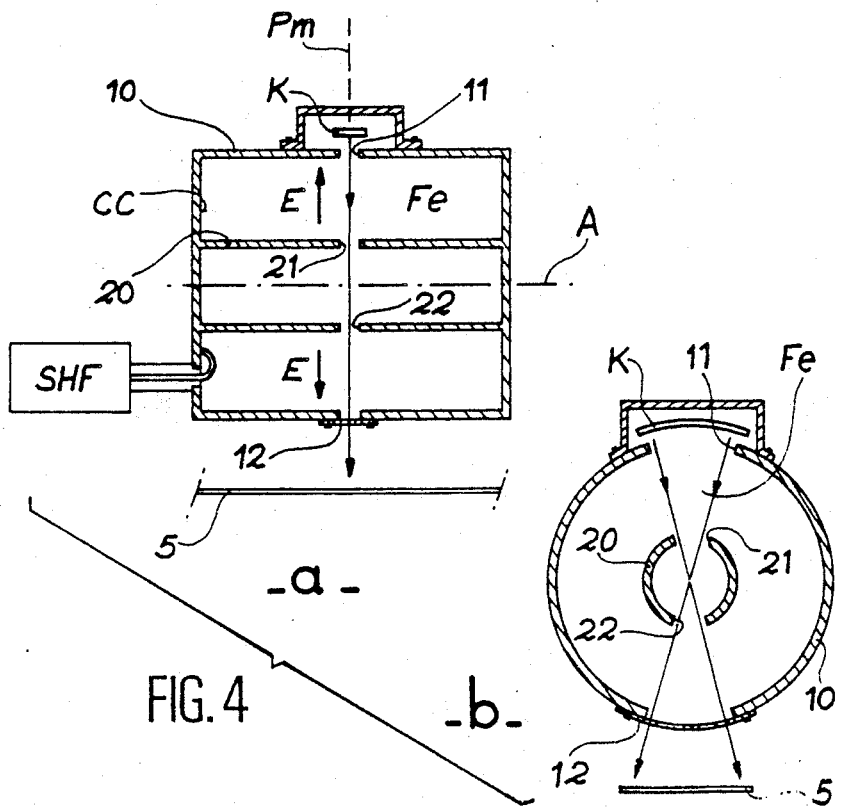

FIG. 4, an electron accelerator according to the invention.

Figure 5:
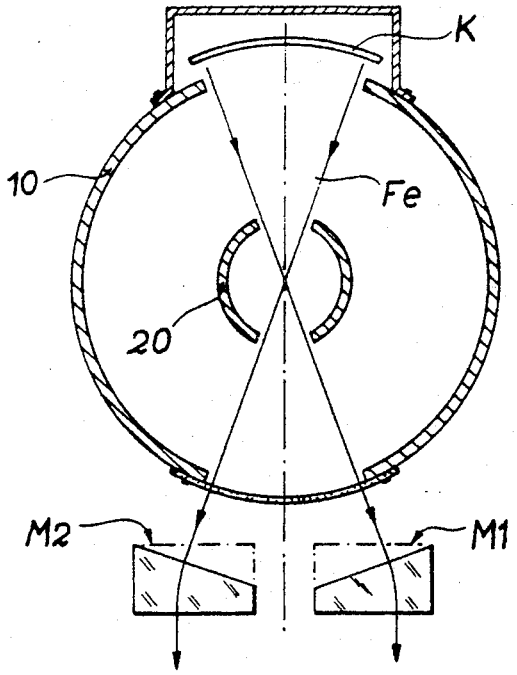

FIG. 5, a variant of the invention using magnetic deflection means.

Figure 6:
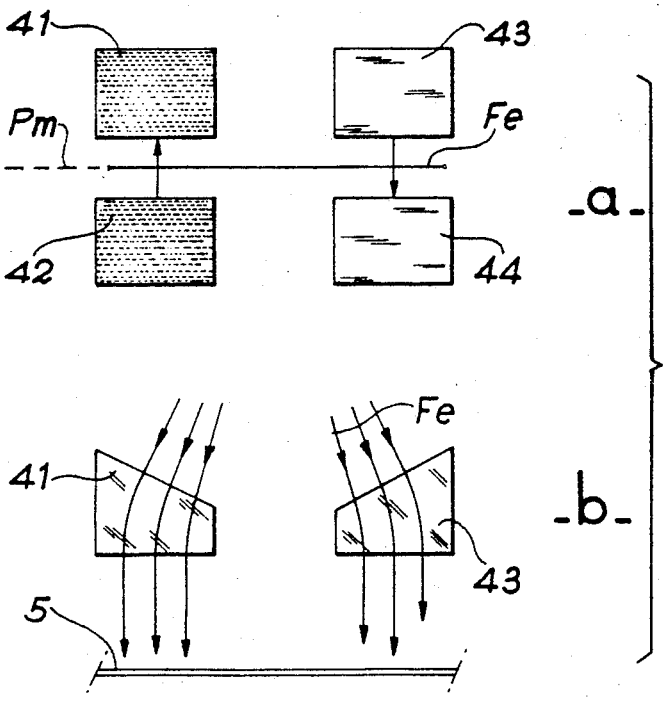

FIG. 6, a first embodiment of the magnetic deflection means.

Figure 7:
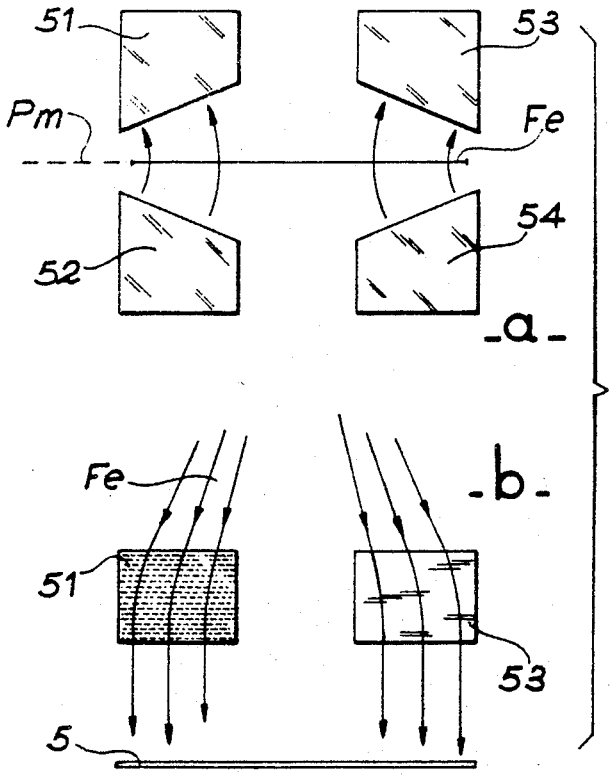

FIG. 7, a second embodiment of the magnetic deflection means.

Figure 8:
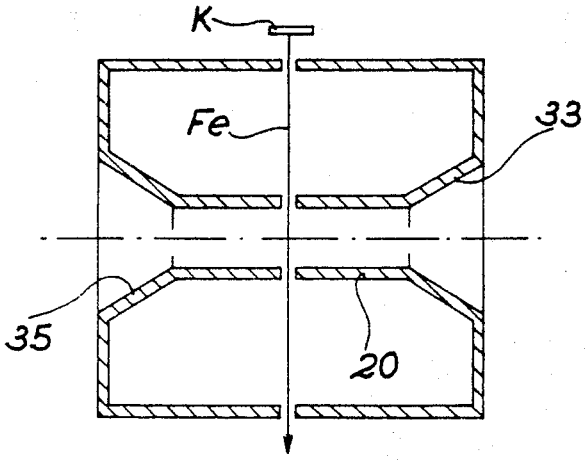

FIG. 8, a constructional variant with low losses.

FIG. 2 shows a coaxial cavity CC constituted by an external cylindrical conductor 10, an internal cylindrical conductor 20 and two flanges 31 and 32. Such a cavity has an axis A and a median plane Pm perpendicular to the axis. Among all the possible resonance modes of such a cavity, the electrically transverse fundamental mode is the only one for which the electric field E is purely radial in the median plane. This field decreases on either side of said plane and is cancelled out on flanges 31,32. Conversely, the magnetic field is at a maximum along the flanges and is cancelled out in the median plane whilst changing direction.

In accordance with standard practice, such a mode can be designated $TE_{001}$, the initials TE indicating that it is a mode where the electric field is transverse, the first 0 indicating that the field has a symmetry of revolution, the second 0 indicating that thereis no cancelling out of the field along a radius of the cavity and the 1 indicates that there is a half-cycle of the field in a direction parallel to the axis. Such a cavity can be supplied by a high frequency source SHF coupled to the cavity by a loop 34.

According to the invention, the electron group or array is injected into the coaxial cavity in the median plane thereof. Thus, it is in this plane that there is no interference field liable to deflect the beam, this point being vital. In part a of FIG. 2, the cavity is shown in cross-section in the median plane. The electric fields E1 and E2 are equal along two seperate radii. A contour 17 is defined by these radii and by two circular arcs along which the electric field is radial. The flow of the electric field (i.e. the integral of this field) is zero along said contour. Therefore, the magnetic induction flux through a surface bearing on said contour also zero. In other words, there is no magnetic component perpendicular to the median plane.

On part b of FIG. 2, it is possible to see the cavity in longitudinal section. The electric field is symmetrical with respect to the median plane, so that fields E3 and E4 located along two infinitely close radii and positioned on either side of said plane are equal. The flow of the electric field along a contour 18 constituted by these two radii and by two longitudinal branches is zero. Therefore, the induction flux across a surface bearing on this contour is also zero. In other words, there is no magnetic component in the median plane.

Thus, there is no magnetic component in the median plane Pm, which amounts to saying that the median plane of the cavity is a purely capacitive zone. In this plane, the electron beam will consequently be exposed to no deflecting force.

FIG. 4 diagrammatically shows an array accelerator according to the invention. Part a is a longitudinal section and part b a section in the median plane of the cavity. The apparatus comprises a cathode K, a coaxial cavity CC, formed from an external cylindrical conductor 10 and an internal cylindrical conductor 20 having the same axis A. The cathode is shaped like a circular arc centred on axis A of the cavity and is itself located in the median plane Pm thereof.

The apparatus functions as follows. Cathode K emits an electron beam Fe directed in the median plane Pm of coaxial cavity CC. The beam penetrates the cavity through a slot-like opening 11 made in the external conductor. The internal conductor 20 also has two slot-like openings 21,22, which are symmetrical with respect to the axis. The electron beam is accelerated by the electric field in the coaxial cavity, if certain phase conditions are satisfied. The beam passes out of the cavity through a slot-like opening 12 made in the external conductor and diametrically opposite to opening 11. The accelerated beam irradiates the strip 5 passing beneath the cavity.

As a result of the coaxial character of the acceleration structure at all times the electric field does not have the same direction in the first and second halves of the path taken by the electrons, or in other words along the radii passing from the external conductor to the internal conductor and then along the radii passing from the internal conductor to the external conductor. However, the field is at high frequency (a few hundred MHz). It is periodically reversed. Thus, the electron beam is injected in such a way that the electric field is cancelled out and changes direction at the instant where the electron pass through the central conductor. The time taken by the electrons to pass from one conductor to the other must therefore be less than the half-cycle of the field. The time taken by the electrons to pass through the entire cavity is consequently less than one cycle of the field.

The use of a coaxial structure makes it possible to obtain a remarkable property, which is the uniformity of the acceleration in the electron array. Thus, each electron emitted by the cathode in the direction of the cavity axis follows a radial trajectory in said cavity and is subject to an accelerating field directed in accordance with said trajectory. Moreover, said field is the same no matter what the radius taken in the angular sector defined by the array. Thus, on leaving the cavity, all the electrons will have undergone the same acceleration and will consequently have the same energy.

If it is wished to irradiate a material in the form of a strip, the dose is only strictly homogeneous if the strip is positioned so as to adapt to the shape of a cylinder coaxial to the cavity (e.g. by a system of rollers).

On using a flat strip, on the one hand the intensity of the radiation decreases with the cosine of the angle of incidence and on the other hand the direction of the radiation is no longer perpendicular to the surface and there is reduced penetration. However, these effects are partly compensated and at the surface the dose received is substantially the same. However, the treated depth remains proportional to the cosine of the angle of incidence.

In order to obtain a uniform penetration, outside the cavity, all the electron trajectories can be made substantially parallel to the median trajectory using two magnets as shown in FIG. 5. In the latter, it is possible to see a deflection means M1 or M2 constituted by two pairs of magnets, whose shapes are shown in FIGS. 6 and 7. In the latter part a is a section perpendicular to the median plane and part b a section in the median plane, i.e. in the plane of the electron beam.

For magnetics of type M shown in FIG. 6, the pole pieces 41–42 on the one hand and 43–44 on the other define two air gaps with parallel sides. The thickness of the magnets increases on moving away from the median plane Pm (part b). The path taken by the electrons between the pole pieces is consequently longer for the electrons following trajectorys remote from the median plane than for trajectories close to said plane. Therefore the action of the magnetic field is increased for the former and decreased for the latter. Therefore the highly inclined trajectories are curved more than the others, which gives parallel trajectories to the beam.

FIG. 7 illustrates another variant of the deflection means. Pole pieces 51–52 on the one hand and 53–54 on the other define air gaps, which move together on moving away from the axis. The magnetic field between such pole pieces increases on moving towards the outside. Thus, there is a greater deflection for the trajectories remote from the median plane than for those close to it.

As the principles of the invention have now been given, certain digital data will now be supplied with regards to the dimensions and the value of the effective shunt impedance. It is known that the latter quantity, which is significant with regards to the quality of the energy transfer to the accelerated electrons is equal to the ratio of the square of the energy transferrable to an electron (expressed in electron-volts) at the power lost by the Joule effect in the cavity.

The calculation shows that for a 400 keV machine, the optimum is obtained for $R2 \simeq 0.265\lambda$ and $R1 \simeq (R2/5)$, $\lambda$ being the wavelength, the cavity length being $L=\lambda/2$. Under these conditions, we e.g. obtain for a frequency of 100 MHz $\lambda=1.67$ m, $R2=0.44$ m, $Zs_{eff} \simeq 6.25$ MΩ, $L=0.835$ m. The shunt impedances obtained in practice are somewhat lower The shunt impedances obtained in practice are somewhat lower (typically 30%) than the calculated values. Therefore the power dissipated in the cavity will be close to 33 KW for a 400 keV machine. The dimensions and power lost are very modest. It can be seen that the optimum is obtained for $(R2/R1) \simeq 5$.

It is also possible to reduce the resistance losses due to the currents circulating in the cavity flanges by modifying the shape of the internal conductor, as illustrated in FIG. 8. The internal conductor 20 is terminated by two truncated cone-shaped parts 33,35. The inductance of the cavity is reduced. In order to retain the same resonant frequency, it is necessary to slightly elongate the cavity.

The advantage obtained from such an arrangement with regards to the shunt impedance is not particularly great (approx. 10%). However, this arrangement has the advantage of significantly reducing the maximum power dissipated per surface area (2 to 4 times less than with the coaxial cavity), which can be of interest for facilitating cooling and for reducing the prejudicial effects (sag, internal tensions, etc) due to the heat gradient in the walls.

We claim:

1. Array electron accelerator, incorporating a linear cathode (K) emitting an electron beam (Fe) in the form of an array, an accelerating structure where there is an electric field (E) directed into the plane of the array, characterized in that the accelerating structure is a coaxial cavity (CC) constituted by an external cylindrical conductor (10) and an internal cylindrical conductor (20) having the same axis (A), said cavity being excited by a high frequecy source (SHF) to the resonant frequency of the fundamental mode and in that the cathode (K) is contained in the median plane (Pm) of the cavity perpendicular to the axis, the electron beam (Fe) emitted by the cathode (K) being injected into the cavity in said median plane, the external (10) and internal (20) cylinders having circular arc-like openings (11,12,21,22) centered on the axis of the cavity for the passage of the beam (Fe).

2. Electron accelerator according to claim 1, characterized in that the central conductor (20) has truncated cone-shaped ends (33,35).

3. Accelerator according to claim 1, characterized in that it also comprises, at the beam exit, a magnetic deflection means (M1,M2) for the electrons constituted by two magnetic circuits symmetrical to the air gap (41,42,43,44 and 51,52,53,54), the lateral edges of the beam respectively traversing these two air gaps, said air gaps being such that the action of the magnetic field on the electrons increases as the electrons are further from the center of the beam.

* * * * *